US006276787B1

(12) United States Patent
Sakanobe et al.

(10) Patent No.: US 6,276,787 B1
(45) Date of Patent: Aug. 21, 2001

(54) INK SUPPLYING DEVICE

(75) Inventors: Minoru Sakanobe, Komaki; Naohisa Kinoshita; Takamitsu Kawai, both of Nagoya; Masaki Takatsugi, Toyohashi, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/132,486

(22) Filed: Aug. 11, 1998

(30) Foreign Application Priority Data

Sep. 26, 1997 (JP) ..... 9-261429
Sep. 26, 1997 (JP) ..... 9-261463

(51) Int. Cl.[7] ..... B41J 2/175
(52) U.S. Cl. ..... 347/86; 347/85
(58) Field of Search ..... 347/85, 86, 87; 222/105; 128/205.13

(56) References Cited

U.S. PATENT DOCUMENTS 4,374,521 * 2/1983 Nelson et al. ..... 128/205.13
4,415,886 11/1983 Kyogoku et al. ..... 340/618
4,928,126 * 5/1990 Asai ..... 347/86
5,040,001 * 8/1991 Dunn et al. ..... 347/86
5,400,066 3/1995 Matsumoto et al. ..... 347/86
5,611,461 * 3/1997 Kubota et al. ..... 222/105
5,691,755 * 11/1997 Pawlowski, Jr. et al. ..... 347/86

FOREIGN PATENT DOCUMENTS 0 674 999 10/1995 (EP) .
0 715 958 A2 6/1996 (EP) .
0 791 465 8/1997 (EP) .
0 826 505 A2 3/1998 (EP) .
0 854 046 7/1998 (EP) .

* cited by examiner

*Primary Examiner*—N. Le
*Assistant Examiner*—Anh T. N. Vo
(74) *Attorney, Agent, or Firm*—Oliff & Berridge, PLC.

(57) ABSTRACT

An ink package has a shape restoring ability and is made of a laminated structure film material in which multiple film sheets of polyethylene or similar material are laminated. Therefore, the ink supplying pressure for ink supplied to the print head is kept at a negative pressure. Since the ink extracting member is formed into a needle-like hollow body, the member can be easily stuck into a recess formed at the ink package.

32 Claims, 11 Drawing Sheets

(w=100 μm)

| THE OUTER DIAMETER d OF THE INK EXTRACTING MEMBER [mm] | 0.7 | 1.2 | 1.6 | 3 | 5 | 6 |
|---|---|---|---|---|---|---|
| THE PRESSING POWER F [gf] | 15 | 24 | 45 | 53 | 89 | 120 |

INK SUPPLYING DEVICE

BACKGROUND OF THE INVENTION

1. Field of the Invention

The invention relates to an ink supplying device which makes it possible to apply negative pressure to ink to be supplied into a print head, without use of a device for adjusting ink supplying pressure.

2. Description of Related Art

Conventionally, in an ink jet printer, ink supplied to a print head is jetted out from multiple nozzles to perform printing. In such a printer, in order to maintain the quality of printed results, it is necessary to keep a jetting ability of the ink jetted out from the print head. The ink jetting ability is kept by making the liquid surface of the ink supplied into the nozzle in the print head into a meniscus (curved surface) in a concave form. The ink liquid surface in a meniscus form is formed by adjusting the ink supplying pressure for the ink supplied into the nozzle of the print head into a negative pressure.

The ink supplying pressure is adjusted by a difference in level between the ink print head and the ink package. When the ink package is arranged, for example, near and below the print head, the difference in level between the ink package and the print head occurs so as to cause a difference in the head of negative pressures. By such a difference in the head of negative pressures, the ink supplying pressure is adjusted into a negative pressure. However, in general a feeding mechanism for feeding printing paper and other devices are disposed below the ink head, and consequently the position and the space for disposing an ink package are limited. Accordingly, in order to dispose an ink package at the limited position or space, it is necessary to make the capacity of the ink package small and frequently exchange the ink package.

Thus, a method is proposed that a small-sized sub-tank is arranged near and below an ink head and an ink package having a large volume is separately arranged as a main tank at a desired position. According to this method, the ink inside the ink package is supplied to the sub-tank arranged near and below the print head by pumping it up, and the ink supplied into the subtank is supplied into a print head under the condition that its ink supplying pressure is adjusted into a negative pressure. Since such a small-sized tank has a small capacity, it can be easily arranged near and below the print head. Furthermore, the volume of the ink package does not have to be downsized, since it is separately arranged at a desired position.

However, according to the adjustment of the ink supplying pressure using the above-mentioned sub-tank, it is necessary to use the sub-tank for adjusting the ink supplying pressure into a negative pressure, and a pumping device for pumping up ink from the ink package to the subtank. Therefore, the number of the parts of the printer increases, and the size of the printer becomes large, which increases the cost for manufacturing the printer. Also, electric power for driving the pumping device becomes necessary, which increases the consumption of electric power of the printer.

On the other hand, in an ink jet printer which is capable of carrying out color printing, inks of four colors including black, yellow, cyan, and magenta are jetted out from multiple nozzles to perform color printing. In such a printer, to maintain good printing quality, it is necessary to maintain a uniform ink jetting ability for the respective inks jetted out from a printer head. The ink jetting ability is maintained uniform by forming the liquid surface of the ink supplied into the nozzle of the printer head into a concave meniscus (curved surface). The ink surface is formed into a meniscus form, for example, by adjusting the ink supplying pressure for the ink to be supplied into the nozzle of the printer into a negative pressure within a specific range. Therefore, it is possible to keep the ink jetting ability for the respective inks uniform by maintaining the ink supplying pressures substantially equal for the respective inks.

The ink supplying pressure is adjusted by a difference in level between the ink head and ink packages in which the inks of the respective colors are disposed. For example, the respective ink packages are adjacently arranged near and below the printer head and at substantially the same levels so as to make level-differences of the printer head from the respective ink packages substantially equal. By arranging the respective ink packages as described above, it is possible to create a substantially equal negative pressure inside the respective packages because substantially equal potential head (energy) differences are generated between the printer head and the respective ink packages.

In the above-mentioned printer, in order to provide a space where the respective ink packages are adjacently arranged in the horizontal (lateral) direction, it is necessary that the length in the lateral direction of the printer is long. However, when the printer that has a long length in the lateral direction is set on a desk or other piece of furniture, the majority of the surface of the desk is occupied by the printer. This is not preferable. Thus, it may be considered that the multiple ink packages are not arranged in the horizontal direction, but are stacked in the vertical direction. This makes it possible to make the length in the lateral direction of the printer short, and consequently the printer-setting area is reduced. Thus, a working space on the desk or other piece of furniture can be effectively used.

However, in the case of stacking the ink packages in the vertical direction, a larger positive pressure is applied to the upper ink package than the lower ink package because of the difference in potential head (energy) between the upper and lower ink packages when ink is extracted from the upper ink package. Thus, the ink supplying pressures in the respective ink packages are not balanced. For this reason, the ink jetting ability for the respective inks cannot be made to be uniform which creates the problem that good printing quality cannot be maintained.

SUMMARY OF THE INVENTION

It is an object of the invention to provide an ink supplying device which makes it possible to apply a negative pressure to ink to be supplied into a print head, without use of a device for adjusting ink supplying pressure.

Another object of the invention is to provide an ink cartridge for use with such an ink supplying device.

Another object of the invention is to provide an ink package for use with such an ink supplying device.

A further object of the invention is to provide an ink package that makes it possible to maintain the ink jetting ability uniform for multiple types of inks to be supplied to printer heads.

In accordance with a first aspect of the invention, an ink supplying device for supplying ink used for printing to a print head is provided, which includes an ink package for sealing the ink, having a laminated structure in which multiple film sheets formed of polyethylene resin or other similar material are laminated, and made of a film material having a shape restoring property, and an ink extracting member having a needle-like tip portion which is stuck into the ink package, for extracting the ink from the ink package by sticking the needle-like tip portion into the ink package, and supplying the extracted ink into the print head.

According to the ink supplying device, the needle-like tip portion of the ink extracting member is stuck into the ink package so that the ink extracting member penetrates into the ink package. The ink sealed inside the ink package is extracted with the ink extracting member and supplied into the print head to be used with the print head for printing.

The ink package is made of a film material having a laminated structure in which a plurality of film sheets formed of polyethylene resin or other similar material are laminated. Thus, the film material intimately contacts the outer surface of the ink extracting member stuck into the ink package. Therefore, when the ink extracting member is stuck into the ink package, it is possible to prevent leakage of ink from the ink package and invasion of air and the like into the ink package. The film material forming the ink package has a shape restoring ability and consequently it is possible to restrain a change in the shape of the ink package caused by a difference between the inner and outer pressures of the ink package. Thus, in the case of extracting ink from the ink package with the ink extracting member, a change in the shape of the ink package can be prevented to keep a negative pressure inside the ink package even if the inner pressure inside the ink package is lowered. As this result, it becomes unnecessary to use an ink supplying adjusting device for keeping the pressure applied to the ink supplied into the print head within a negative pressure.

The ink package may have an ink sealing portion for sealing the ink, and a part of the outer surface of the ink sealing portion is formed into a substantial plane or concave form.

According to this ink supplying device, the needle tip portion of the ink extracting member is stuck into the outer surface in a substantial plane or concave form of the ink sealing portion, so that the ink extracting member penetrates into the ink sealing member.

Therefore, the ink extracting member can be easily stuck into the ink sealing portion of the ink package so as to penetrate into the portion, since a part of the outer surface of the ink sealing portion of the ink package is formed into a substantial plane or concave form.

Further, both sides of the film material may be melt-joined, whereby the outer surface of the ink sealing portion formed into a substantial plane or concave form is made on a face crossing both of the sides that are melt-joined.

Therefore, it is unnecessary that the ink package is separately equipped with any member for making the outer surface of the ink package into a substantial plane or concave form, thereby simplifying the steps of making the ink package and reducing the cost of manufacture.

Further, the film material forming the ink sealing portion may have a thickness of approximately 30 $\mu$m to 300 $\mu$m.

Therefore, the shape restoring ability of the film material can be improved, since the film material is formed to have a thickness of approximately 30 $\mu$m to approximately 300 $\mu$m. The negative pressure applied to ink supplied into the print head can also be maintained within the range that the print head can be operated, since the formation of the film material having a thickness of approximately 300 $\mu$m or less restrains an excessive increase in the negative pressure applied into the ink package. The ink extracting member can also be easily stuck and inserted into the ink package, since the film material is formed to have a thickness of approximately 300 $\mu$m or less.

Further, the ink package may have an ink sealing portion for sealing the ink, and the longitudinal length of the ink sealing portion is approximately ten times or less as long as the lateral length thereof.

Therefore, the shape restoring ability of the film material forming the ink package can be improved, since the length in the longitudinal direction is approximately ten times or less as long as the length in the lateral direction, about the ink sealing portion of the ink package.

Further, the ink package may have an ink sealing portion for sealing up the ink, and one of the longitudinal length and the lateral length of the ink sealing portion is approximately 200 mm or less.

Therefore, the shape restoring ability of the film material forming the ink package can be improved, since either one of the length in the longitudinal direction or the length in the lateral direction is approximately 200 mm or less, about the ink sealing portion of the ink package.

In accordance with a second aspect of the invention, an ink package is for supplying ink for using printing to a printer head and includes an upper package for sealing the ink and a lower package for sealing the ink which is disposed below the upper package, wherein the upper package has a shape-restoring ability.

According to the ink package, ink is extracted by, for example, a needle or other similar device for extracting ink. Namely, in the case of extracting ink, the tip portions of the needles or other similar devices for extracting ink are stuck into the upper and lower packages, respectively, to penetrate into them. The ink sealed inside each of the respective packages are extracted with the needles or other similar devices for extracting ink and then supplied to printer heads for use in printing.

The upper package is arranged over the lower package but has a shape-restoring ability. Thus, even if ink is extracted from the upper package and then its inner pressure is lowered, the change in shape of the upper package is restrained and the inner pressure is kept within a negative pressure.

Therefore, even if a greater positive pressure is applied to the upper package than to the lower package by a potential head difference between the upper and lower packages, the balance of the pressure applied to the ink to be supplied from each of the respective packages to the printer heads can be maintained.

Further, the upper and lower packages may be made of a film material having a shape-restoring ability, and the shape-restoring ability of the film material for forming the upper package is larger than that of the film material for forming lower package.

Therefore, the upper and lower packages are made of a film material having a shape-restoring ability, and consequently even if the inner pressure inside the packages is reduced by extracting ink from the packages with the needles or other similar devices for extracting ink, the change in shape of the packages can be restrained so that the inner pressure inside the respective packages can be kept within a negative pressure.

Furthermore, the inner pressure inside each of the upper packages is kept lower than that inside the lower package since the film material for forming the upper package has a greater shape-restoring ability than the film material for forming the lower package. Thus, the balance of the pressure applied to the ink to be supplied from each of the respective packages to the printer heads is maintained even if a larger positive pressure is applied to the upper package than to the lower package by the potential head difference between the upper and lower packages.

Further, the ink package may have a deformation restraining member fitted to either one of the upper or lower package to restrain the deformation thereof. The other of the upper or lower package is made of the film material having a shape-restoring ability. The film material for forming the upper package or the deformation restraining member fitted to the upper package is more rigid than the deformation restraining member fitted to the lower package or the film material for forming the lower package.

Therefore, the deformation restraining member is fitted to one of the upper or lower package, and the other thereof is made of the film material having shape-restoring ability. Thus, the deformation of the packages is restrained to keep the pressure inside the respective packages within a negative pressure even if ink is extracted from each of the respective packages with needles or other similar devices for extracting ink so that the inner pressure inside the respective packages is lowered.

The film material for forming the upper package is more rigid than the film material for forming the lower package. Thus, the inner pressure inside the upper package is kept at a lower negative pressure than that inside the lower package. Thus, the inner pressure inside the upper packages can be kept lower than that inside the lower package since the film material for forming the upper package has a greater shape-restoring ability than the film material for forming the lower package. Thus, it is possible to maintain the balance of the pressure applied to the ink to be supplied from each of the respective packages to the printer heads even if a larger positive pressure is applied to the upper package than to the lower package by the potential head difference between the upper and lower packages. Accordingly, the ink jetting ability for each of the respective inks is made uniform so that a good print quality can be maintained.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Figure 1:
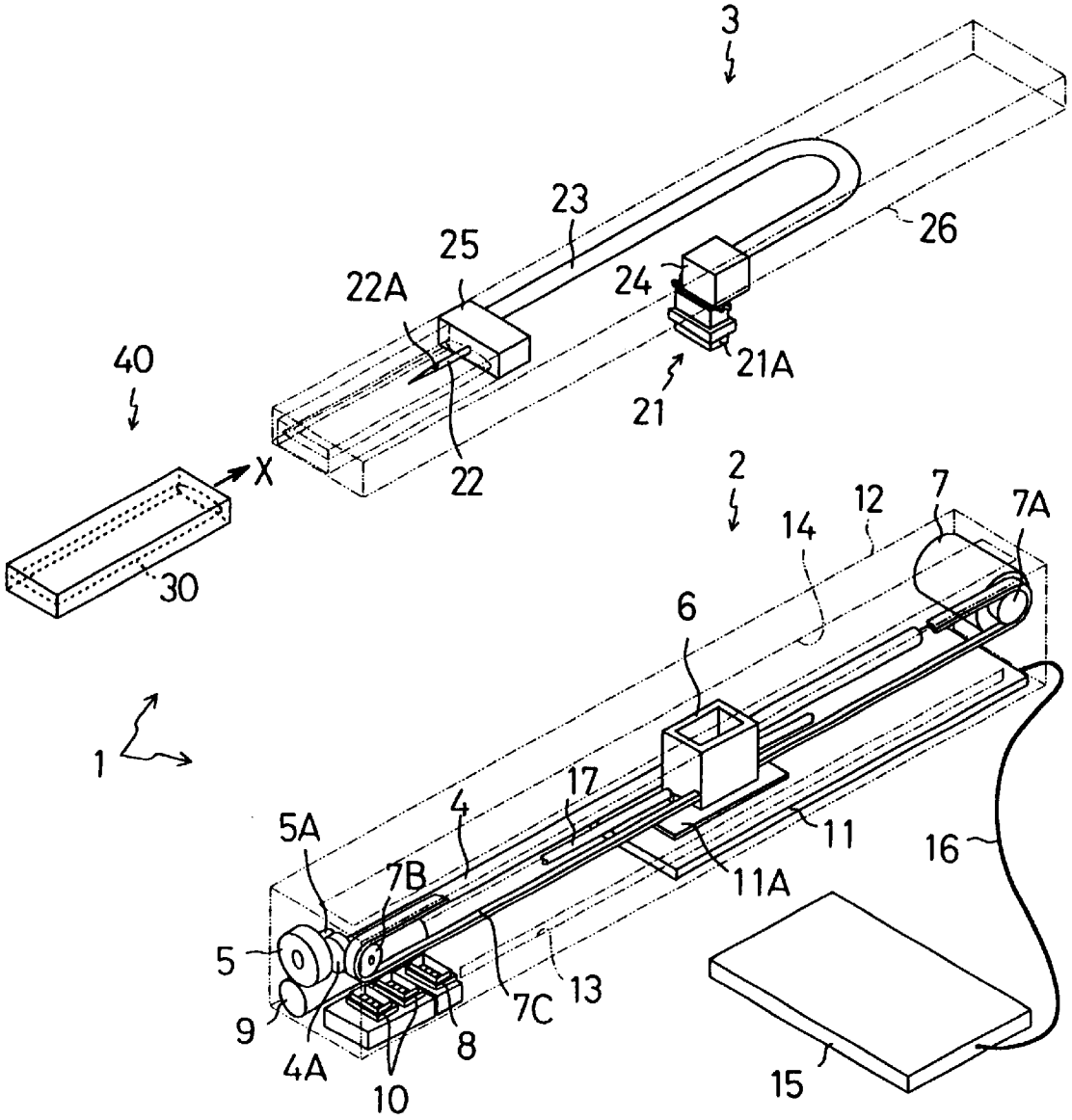
FIG. 1 is a perspective view of a disassembled desktop printer on which an ink supplying device, in accordance with an embodiment of the invention, is mounted.
Figure 2:
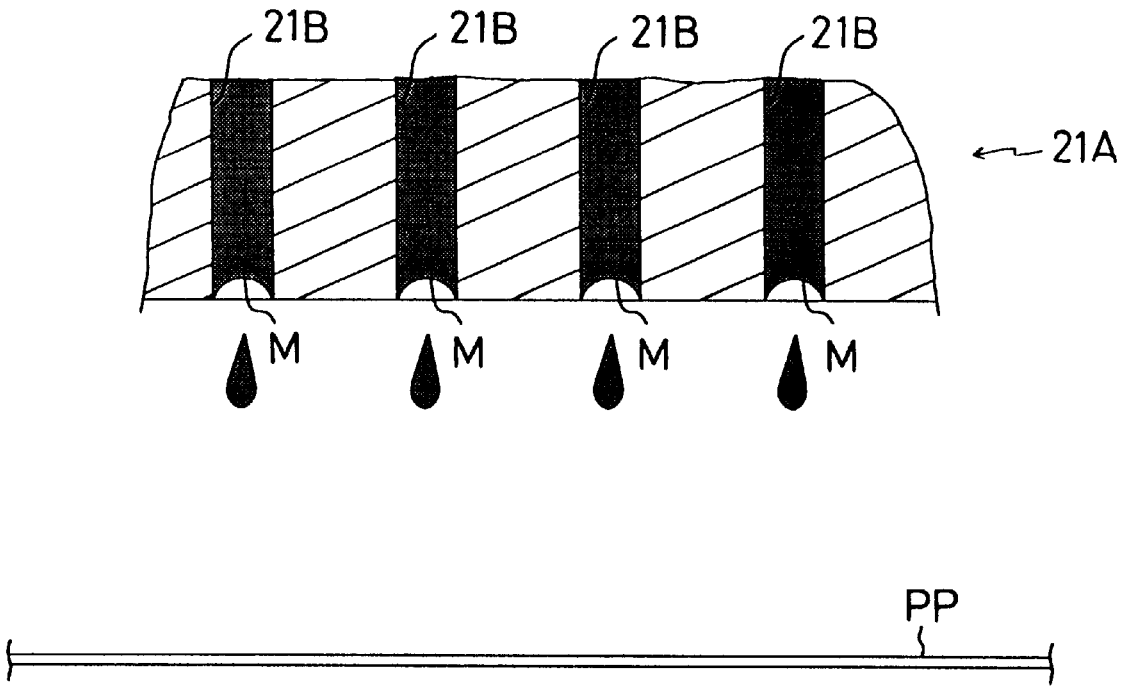
FIG. 2 is a partial, schematic cross section of a nozzle portion of a print head.

Preferred embodiments of the invention will be described below, referring to the attached drawings. FIG. 1 is a perspective, disassembled view illustrating a desktop printer 1 on which an ink supplying device, in accordance with an embodiment of the invention, is mounted. FIG. 2 is a partial sectional, schematic view of a nozzle portion 21A of a print head 21. The desktop printer 1 has a printer body 2 formed into a box-like shape, a printer cartridge 3 which is removeably fitted onto the upper portion of the body 2 and has the mounted print head 21, and an ink cartridge 40 inside which an ink package 30 is received. In FIG. 1, a body frame 12 of the printer body 2, a sheet feeding-out opening 13, a head moving groove 14 and a cartridge frame 26 of the printer cartridge 3 are represented by a line having an alternating long and two short dashes. An arrow X in FIG. 1 represents the direction for fitting the ink cartridge 40.

To the body frame 12 of the printer body 2, a platen roller 4, which is a feeding roller for feeding a print paper PP (see FIG. 2) is axially supported and a guide rod 17 in parallel to the platen roller 4 is fixed. The left end portion of the platen roller 4 is furnished with a trailing gear 4A. The trailing gear 4A is meshed with a driving gear 5A which is rotated with an LF motor 5. Thus, by rotating the LF motor 5, the platen roller 4 is rotated to feed the print paper PP. The guide rod 17 is slidably stuck and fitted into a carriage 6 to support the carriage 6 under the condition that the carriage 6 can be moved along the direction perpendicular to the feeding direction of the print paper PP. In FIG. 1, a part of the guide rod 17 is omitted.

The carriage 6 is a member on which the print head 21 of the printer cartridge 3 is mounted, and can travel and return along a direction parallel to the guide rod 17 and the platen roller 4, that is, the longitudinal direction of the printer body 2, through a belt 7C which is stretched tight between a driving pulley 7A which can be rotated with a carriage motor 7 mounted on the right end portion of the body frame 12 and a trailing pulley 7B disposed at the left end portion of the body frame 12. Thus, the print head 21 mounted on the carriage 6 is advanced and returned along the longitudinal direction of the printer body 2, so that printing on the print paper PP can be carried out. A part of the belt 7C is omitted in FIG. 1 for easily understanding the platen roller 4 and the guide rod 17.

At the left end portion of the printer body 2, a suction cap 8 with which multiple nozzle openings 21B (see FIG. 2) in a nozzle portion 21A of the print head 21 can be sealed, and a suction pump 9 for sucking ink inside the nozzle openings 21B of the nozzle portion 21A sealed with the suction cap 8, are disposed. When restoring an ink jetting condition by the suction cap 8 and the suction pump 9 (purge treatment), the carriage 6 on which the print head 21 is mounted is moved to the left side of the desktop printer 1 with the carriage motor 7, and then the respective nozzle openings 21B of the nozzle portion 21A in the print head 21 are sealed with the suction cap 8. Subsequently, when the suction pump 9 is operated, bubbles and ink solidified by drying are sucked from the nozzle openings 21B so that the jetting condition of the nozzle openings 21B of the nozzle portion 21A can be restored. This purge treatment is conducted in the case wherein the concave meniscus M (see FIG. 2) formed of the liquid surface of the ink disposed in the nozzle openings 21B is broken.

The left side of the suction cap 8 is equipped with a protecting cap 10 with which the nozzle portion 21A of the print head 21 is covered. When printing is not carried out with the print head 21, that is, when the carriage 6 stands by, the nozzle portion 21A is covered with the protecting cap 10, so as to prevent the inside ink from being vaporized thereby avoiding drying ink at the respective nozzle openings 21B.

The lower portion of the printer body 2 is equipped with a controlling circuit substrate 11 on which, for example, a CPU 11A is mounted for controlling the desktop printer 1 in accordance with a controlling program regarding the operation of the desktop printer 1. A PC card 15 is connected to the controlling circuit substrate 11 through a connecting cord 16. The PC card 15 is stuck into a PC card slot of a personal computer (not shown), and makes it possible to input printing data or other similar data outputted from the personal computer into the desktop printer 1. To the desktop printer 1, electric power is supplied from the personal computer through the PC card 15 stuck into the PC card slot and the connecting cord 16.

The front wall of the body frame 12 of the printer body 2 has a sheet feeding-out opening 13 for feeding out the print paper PP on which printing has been performed from the printer body 2. The rear wall of the body frame 12, that is, the wall opposite to the wall having the sheet feeding-out opening 13 has, at the position facing the sheet feeding-out opening 13, a paper inserting opening (not illustrated) for inserting the print paper PP, which has not yet been used, into the printer body 2. The upper surface of the body frame 12 has a head moving groove 14 having a rectangular shape. Therefore, when the printer cartridge 3 is fitted to the printer body 2, the print head 21 can be mounted on the carriage 6 through the head moving groove 14.

The printer cartridge 3 can be freely installed or removed from the printer body 2, and the print head 21, an ink extracting member 22, an ink supplying tube 23, joining members 24 and 25, and a cartridge frame 26 formed into a box shape for receiving the print head 21 and other similar devices. The print head 21 has the nozzle portion 21A formed of a piezoelectric element. As shown in FIG. 2, the nozzle portion 21A is furnished with multiple nozzle openings (ink jetting openings) 21B. The respective nozzle openings 21B are filled with ink supplied from the ink package 30. When a voltage is applied to the nozzle portion 21A formed of a piezoelectric element, strain is generated in proportion with the voltage at the nozzle portion 21A, so that the respective nozzle openings 21B are contracted. This contraction causes the ink with which the respective nozzle openings 21B are filled to be jetted onto the print paper PP, thereby performing printing.

The respective nozzle openings 21B are arranged at intervals of approximately 180 dpi. The carriage 6 is advanced and returned in the longitudinal direction of the printer body 2 (see FIG. 1), so that printing can be performed at a dissolution of 180 dpi.

When the ink liquid surface at the lower side of the interior of the respective nozzle openings 21 becomes a meniscus M in a concave form, the jetting ability of the ink is maintained to provide a vivid printed result. The meniscus M in a concave form is produced by keeping the ink supplying pressure for the ink disposed in the respective nozzle openings 21B within a negative pressure. For example, in the case of the print head 21 used in the present embodiment, it is possible to make the ink liquid surface inside the respective nozzle openings 21B into a concave meniscus M if the ink supplying pressure is approximately 0 mmAq (water column) to 100 mmAq (water column) against the atmospheric pressure (within the range of print head workable pressure). A method for keeping ink supplying pressure within a negative pressure, as well as the ink package 30, will be described later.

As shown in FIG. 1, the joining member 24 for joining the print head 21 and one end of the ink supplying tube 23 is arranged at the upper portion of the print head 21. The other end of the ink supplying tube 23 is joined to the ink extracting member 22 through the joining member 25. The ink extracting member 22 extracts ink from the ink package 30 received inside the ink cartridge 40. The ink extracted with the ink extracting member 22 is supplied through the ink supplying tube 23 and the joining members 24 and 25 to the print head 21. The ink supplying tube 23 is integrated with a harness (not illustrated) and other similar devices, for supplying electric power for driving the print head 21.

The ink extracting member 22 is made of metal or ceramics having corrosion-resistance such as a stainless steel, and is stuck into the ink sealing portion 31 of the ink package 30 to extract ink sealed inside it. The ink extracting member 22 is made into a hollow needle form (see FIG. 3). Its tip has an ink extracting opening 22A for extracting ink inside the ink sealing portion 31. Thus, when the ink cartridge 40 which receives the ink package 30 is slid in the arrow X direction and fitted to the printer cartridge 3 (the alternate long and two short dashes line in FIG. 1), the ink extracting member 22 is stuck through a penetrating hole 42 (see FIG. 3) of the ink cartridge 40 into the ink sealing portion 31 so that the ink inside the ink package 30 flows from the ink extracting opening 22A into the ink extracting member 22.

The ink which has flowed into the ink extracting member 22 in the above-mentioned manner flows through the joining member 25 to the ink supplying tube 23, and further is supplied through the joining member 24 to the print head 21. The outer diameter d (see FIG. 3) of the ink extracting member 22, as well as the ink package 30, will be described later.

Figure 3:
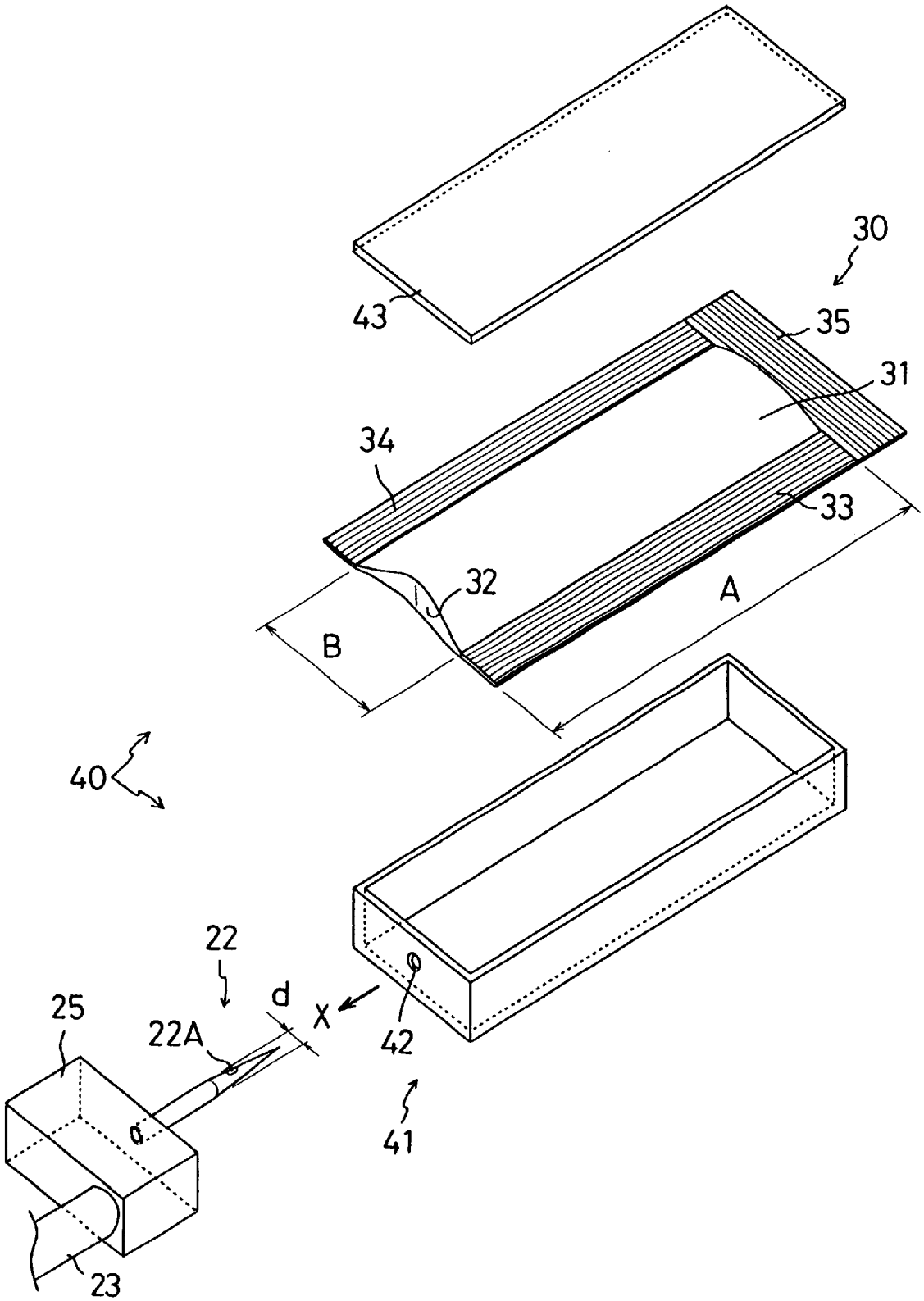
FIG. 3 is a perspective view of a disassembled ink cartridge.

The following will describe the ink package 30 and the ink cartridge 40 for receiving it, referring to FIGS. 3–6. FIG. 3 is a perspective view of the disassembled ink cartridge 40. As shown in FIG. 3, the ink cartridge 40 is made in a substantially box-like and hollow body to be installed and removed from the printer cartridge 3 (see FIG. 1). The cartridge body 41 of the ink cartridge 40 is open at its upper portion to receive the ink package 30. The ink package 30 is received inside it, and then is covered with an upper cover 43. After the package 30 is covered with the upper cover 43, the upper cover 43 is melted and joined to the cartridge body 41 to be fitted thereto. In the case of fitting the upper cover 43, engaging members or other similar devices are disposed at the cartridge body 41 and the upper cover 43 so that the upper cover 43 is fitted to the cartridge body 41, without melting both of these elements.

The left side face of the cartridge 41 has a penetrating hole 42. The penetrating hole 42 is a hole through which the ink extracting member 22 is stuck into the ink cartridge 40. The ink extracting member 22 is stuck into the penetrating hole 42, so that the ink extracting member 22 can be inserted into a recess 32 of the ink package 30 received inside the ink cartridge 40. When the ink cartridge 40, initially fitted to the printer cartridge 3, is removed from it, leakage of ink from the ink cartridge 40 can be prevented by setting a sealing member such as a packen made of, for example, NBR (acrylonitril butadiene rubber) to this penetrating hole 42. When the ink package 30 is received inside the ink cartridge 40, melt-joined portions 33, 34 and 35 may be bent for the reception. Alternately, the melt-joined portions 33, 34 and 35 may be cut and then the ink package 30 may be received inside the cartridge body 41.

Figure 4:
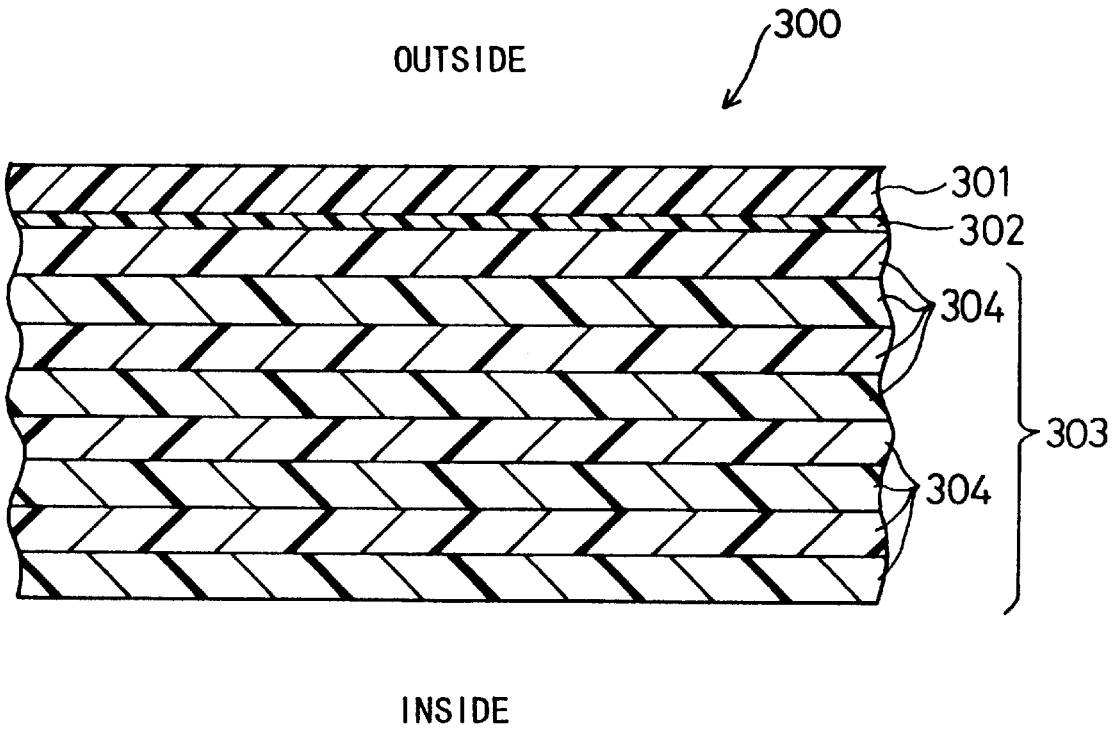
FIG. 4 is an extended sectional view of a film material having a laminated structure.

As shown in FIG. 3, the ink package 30 is made into a substantially rectangular, bag-like form, and is formed of a laminated-structure film material in which multiple film sheets, for example, approximately ten sheets, of polyethylene resin or other similar material are laminated. The laminated-structure film material is approximately 180 $\mu$m in thickness. More specifically, as shown in FIG. 4, the laminated-structure film material 300 includes an outer rigid film 301 and an inner ductile film 303. The films 301 and 303 are bonded to each other with an adhesive layer 302 interposed between them.

The outer rigid film 301 is a synthetic resin film which has a low elongation percentage, and which is high in mechanical strength, such as tensile strength and rigidity. The outer rigid film 301 may be a film not oriented of polyamide nylon or other nylon, polyethylene terephthalate(PET), or polyimide. The outer rigid film 301 is approximately 20 $\mu$m in thickness.

The inner ductile film 303 is a synthetic film which has a high elongation percentage. The inner ductile film 303 may be formed of several sheets of films 304 not oriented of low density polyethylene, polypropylene or other polyolefine, polyvinyl chloride, or other similar material. Each film 304 is approximately 20 $\mu$m in thickness.

As shown in FIG. 3, the ink package 30 has at its substantially central portion the ink sealing portion 31. Inside the portion 31, ink for use in printing is sealed. The recess 32 is formed at the left end portion of the ink sealing portion 31. The recess 32 is a portion through which the ink extracting member 22 is stuck. Since its both end portions are supported with the melt-joining portions 33 and 34, the recess 32 is made into a substantially concave form, viewed from above. Thus, the ink extracting member 22 is stuck into the recess 32, so that the ink extracting member 22 can easily penetrate into the ink sealing portion 31.

In a method for making the ink package 30, first a rectangular, laminated-structure film material is folded into two, and then the single side opposite to the folded edge portion, among the edge portions resulting from folding is melt-joined to form the melt-joined portion 35. Thus, a hollow, cylindrical body is formed. Since two opposite edge portions of this hollow, cylindrical body are open, either one of them is melt-joined to form the melt-joined portion 33, thereby forming a bag whose edge portion where the melt-joined portion 34 will be formed is open. After the formation of the bag, ink is poured into the bag from its open portion. After pouring the ink, the portion opposite to the melt-joined portion 33 is melt-joined to form the melt-joined portion 34. At this time, the recess 32 is formed at the edge portion of the ink sealing portion 31 and simultaneously, at the one end of the bag, the ink package 30 is formed in which ink is sealed inside the ink sealing portion 31. After forming the ink package 30, the melt-joined portion 34 is cut so that the ink package 30 is cut off from the bag, thereby finishing the formation of the ink package 30. When ink is poured, it is possible to prevent air and the like from invading into the ink sealing portion 31 of the ink package which has not yet been used by keeping the inner pressure P of the ink sealing portion 31 within a positive pressure.

The following will describe a method for maintaining the ink supplying pressure of ink supplied to the print head 21. The ink package 30 is made of the laminated structure-film material described above. Therefore, it has, when the ink extracting member 22 is stuck thereinto, the property (intimate contact property) of intimately contacting the outer surface of the stuck ink extracting member 22. As a result, it is possible to prevent leakage of ink from the ink sealing member 31 and invasion of air and the like into the ink sealing portion 31. In particular when ink is extracted (consumed) with the ink extracting member 22, invasion of air and the like into the ink sealing portion 31 is prevented. Therefore, the volume corresponding to the amount of ink consumed inside the ink sealing portion 31 is not substituted with air and the like. Accordingly, the inner pressure P in ink sealing portion 31 can be maintained within a negative pressure.

By strengthening the toughness of the laminated structure film material forming the ink package 30, a shape restoring ability is provided to this film material and a change in the shape of the ink sealing portion 31 of the ink package 30 is restrained. Thus, when ink is extracted from the ink sealing portion 31 with the extracting member 22, the ink sealing portion 31 is not crushed by atmospheric pressure or the like, so that the inner pressure P in the ink sealing portion 31 can be kept within a negative pressure. As a result thereof, when ink extracted with the ink extracting member 22 is supplied into the print head 21, the ink supplying pressure for the ink can be kept within a negative pressure.

Figure 5:
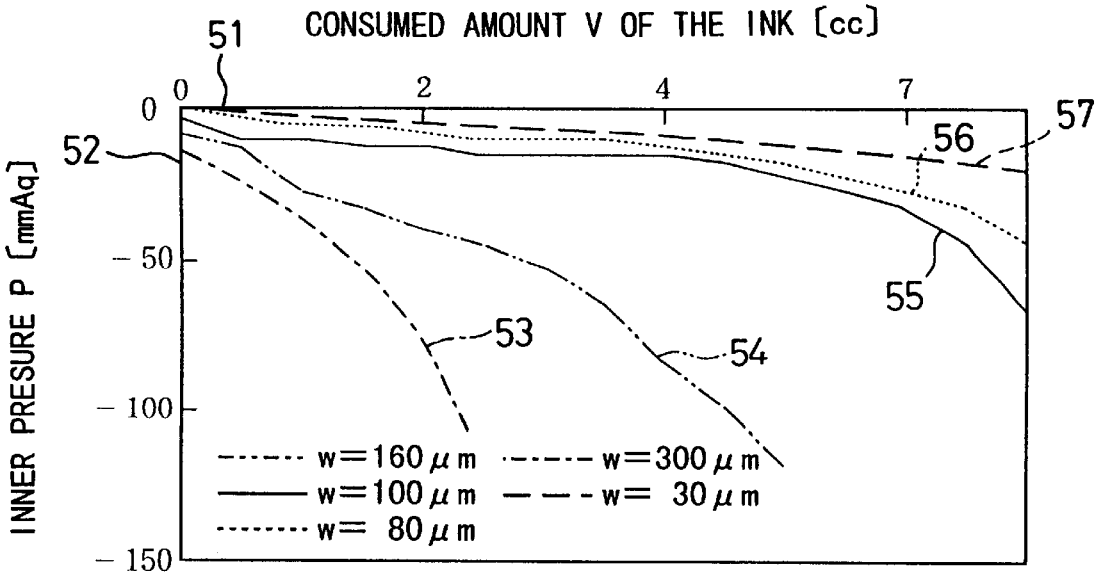
FIG. 5 is a graph comparing ink packages in which thickness of the laminated structure film materials is different.
Figure 6:
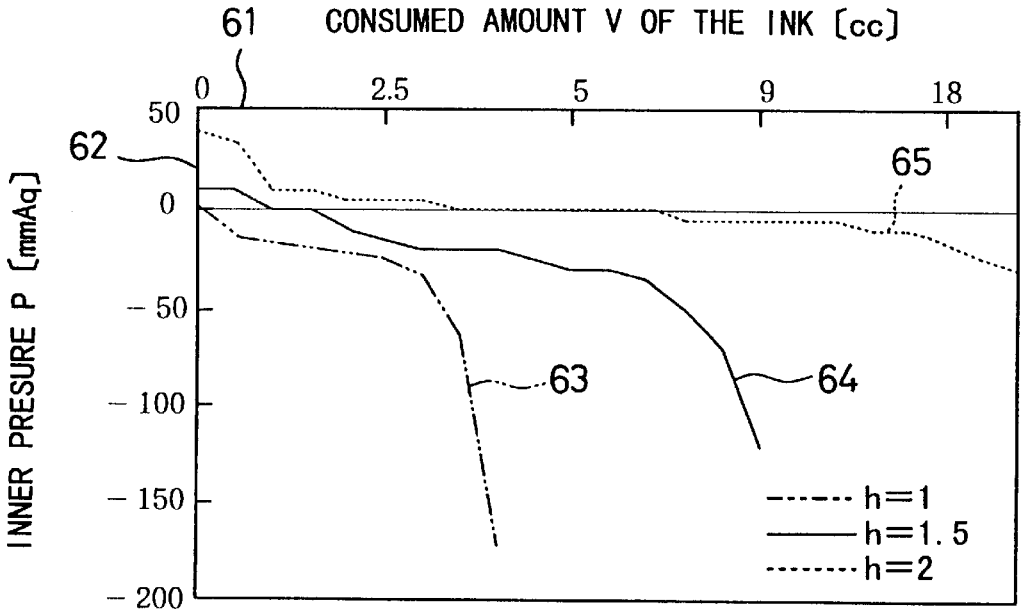
FIG. 6 is a graph comparing ink packages in which the ratio of the length in the longitudinal direction to the length in the lateral direction (aspect ratio) is different.
Figures 7, 8:
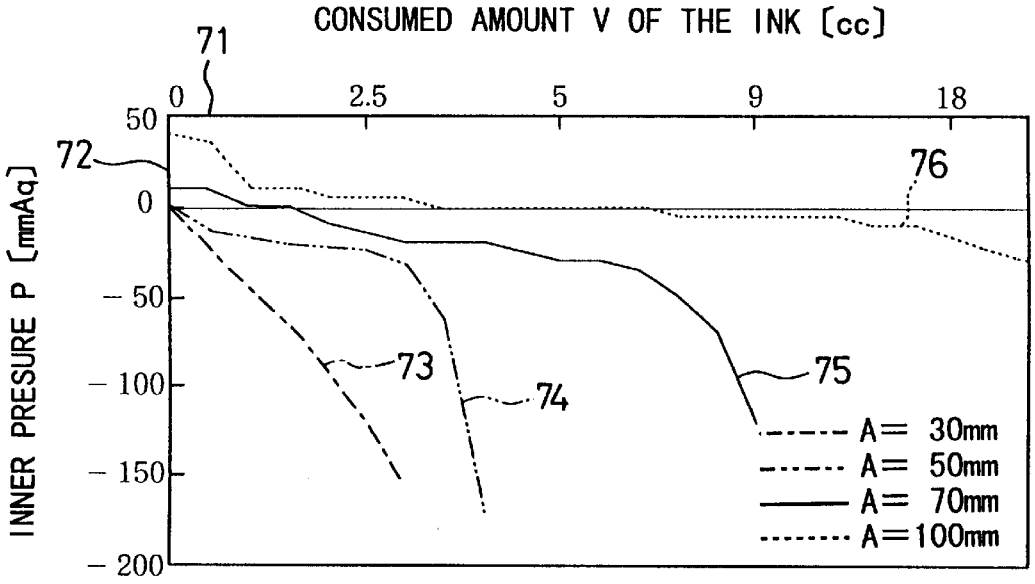
FIG. 7 is a graph comparing ink packages in which either one of the length in the longitudinal direction or the length in the lateral direction is different.
FIG. 8 is a view showing the relationship between the outer diameter of the ink extracting member and the pressing power against the ink package.

Referring to FIGS. 5–7, a specific method for strengthening the toughness of the laminated structure film material will be described below. FIGS. 5–7 are respectively graphs showing the relationship between the amount V of consumed ink and the inner pressure P inside the ink sealing portion 31.

FIG. 5 is a graph comparing ink packages 30 in which thickness w of the laminated structure film materials is different, FIG. 6 is a graph comparing ink packages 30 in which the ratio h of the longitudinal direction length A to the lateral direction length B (aspect ratio) of the ink sealing portion 31 is different, and FIG. 7 comparing ink packages 30 in which either one of the longitudinal direction length A or the lateral direction length B of the ink sealing portion 31 is different. In FIGS. 5–7, the horizontal axes 51, 61 and 71 represent the consumed amount V of the ink sealed inside the ink sealing portion, and the vertical axes 52, 62 and 72 represent the inner pressure P inside the ink sealing portion 31. In FIG. 3, arrow X represents the direction for fitting the ink cartridge 40.

About the thickness w of the laminated structure film materials in the respective ink packages 30 shown in FIG. 5, the curves 53 (alternating long and short dashed line), 54 (alternating long and two short dashed line), 55 (solid line), 56 (broken line) and 57 (correspond to 300 $\mu$m, 160 $\mu$m, 100 $\mu$m, 80 $\mu$m and 30 $\mu$m, respectively. When the respective curves 53–57 are compared, with increase in the amount V of consumed ink the inner pressure P drastically decreases in the order of curves 53, 54, 55, 56 and 57. In other words, as the thickness w of the laminated structure film material increases, the toughness of the film material forming the ink sealing portion 31 increases. Therefore, the shape restoring ability of the laminated structure film material becomes significantly large, and a change in the shape of the ink sealing portion 31 is restrained. Thus, in the present embodiment, on the basis of the result from FIG. 5, the thickness w of the laminated structure film material is set from approximately 30 $\mu$m to approximately 300 $\mu$m, in order to set the ink supplying pressure, that is, the inner pressure P inside the ink sealing portion 31, within the print head workable pressure range from approximately −100 mmAq to approximately 0 mmAq.

Since in the present embodiment the thickness w of the laminated structure film material is set approximately 30 $\mu$m to approximately 300 $\mu$m in the aforementioned manner, an excessive increase in heating time and an excessive rise in heating temperature are prevented in the heating (melt-joining) step for forming the melt-joined portions 33, 34 and 35 of the ink package 30. Thus, the cost for making the ink package 30 can be reduced. Furthermore, it is possible to reduce resistant power caused when the ink extracting member 22 is stuck into the ink package 30, by setting the thickness of the laminated structure film material within the aforementioned range.

About the aspect ratio h of the ink sealing portion 31 of the respective ink packages 30 shown in FIG. 6, the curves 63 (alternating long and two short dashed line), 64 (solid line) and 65 (broken line) correspond to "1", "1.5" and "2", respectively. When the respective curves 63–65 in FIG. 5 are compared, with an increase in the amount V of consumed ink, the inner pressure P drastically decreases in the order of curves 63, 64 and 65. In other words, as the aspect ratio h of the ink sealing portion 31 decreases, the toughness of the laminated structure film material forming the ink sealing portion 31 increases. Therefore, the shape restoring ability of the laminated structure film material becomes significantly large, and a change in the shape of the ink sealing portion 31 is prevented. Thus, in the present embodiment, on the basis of the result from FIG. 6, the aspect ratio h of the ink sealing portion 31 is set about "2" or less, that is, the length in the longitudinal direction A (the length in the lateral direction) of the ink sealing portion 31 is set to about 2 or less times as long as the lateral direction length B (the length in the longitudinal direction A), in order to set the ink supplying pressure, that is, the inner pressure P in the ink sealing portion 31 within the print head workable pressure range from approximately −100 mmAq to approximately 0 mmAq.

About the length in the longitudinal direction A (the length in the lateral direction B) of the ink sealing portion 31 of the respective ink packages 30 shown in FIG. 7, the curves 73 (alternating long and short dashed line), 74 (alternating long and two short dashed line), 75 (solid line), and 76 (broken line) correspond to 30 mm, 50 mm, 70 mm and 100 mm, respectively. When the respective curves 73–76 in FIG. 7 are compared, with an increase in the amount V of consumed ink, the inner pressure P drastically decreases in the order of curves 73, 74, 75 and 76. In other words, as the length in the longitudinal direction A (the length in the lateral direction B) of the ink sealing portion 31 decreases, the toughness of the ink sealing portion 31 increases. Therefore, the shape restoring ability of the laminated structure film material becomes significantly large, and a change in the shape of the ink sealing portion 31 is prevented. Thus, in the present embodiment, on the basis of the result from FIG. 7, the longitudinal direction length A (the lateral direction length) of the ink sealing portion 31 is set about 100 or less mm, in order to set the ink supplying pressure, that is, the inner pressure P in the ink sealing portion 31 within the print head workable pressure range from approximately −100 mmAq to approximately 0 mmAq.

The following will describe the relationship between the intimate contact power of the ink package 30 with the ink extracting member 22 and the outer diameter d of the ink extracting member 22, referring to FIG. 8. FIG. 8 is a view showing the relationship between the outer diameter d of the ink extracting member 22 and the pressing power F against the ink package 30. The pressing power F is the pressing power that the ink extracting member 22 is pulled out from the ink package 30 when the ink extracting members 22, having different outer diameters d, are stuck into the ink package 30 and subsequently the ink package 30 is pressed in its thickness direction. The ink package 30 that is used is one in which the thickness w of the laminated structure film material is approximately 100 $\mu$m.

As shown in FIG. 8, as the outer diameter d of the ink extracting member 22 increases, the pressing power F that the ink extracting member 22 is pulled out from the ink package 30 increases. Preferably, the pressing power F is approximately 100 g or less. On the basis of this result, the outer diameter d of the ink extracting member 22 is set to about 5 mm or less, in order to maintain the intimate contact power of the outer surface of the ink extracting member 22 stuck into the ink package 30 with the laminated structure film material of the ink package 30.

The ink package 30 and the ink extracting member 22 thus formed are used to supply ink into the print head 21, so that the ink supplying pressure is kept within a negative pressure. Thus, it is not necessary to use a sub-tank for making the ink supplying pressure into a negative pressure or a pump device for supplying ink near and below the print head 21. Thus, the number of parts of the desktop printer 1 is lowered to reduce the cost manufacturing it. The pump for supplying ink, and other similar devices also become unnecessary, thereby reducing the electric power consumed by the desktop printer 1.

The following will describe a method for assembling the desktop printer 1, referring to FIGS. 1–3. At first, the melt-joined portions 33–35 of the ink package 30 are folded, or cut off, so as to receive the ink package 30 inside the cartridge body 41, as shown in FIG. 3. After the receipt of the ink package 30, the upper portion of the cartridge body 41 is covered with the upper cover 43 and then the cartridge body 41 and the upper cover 43 are melt-joined, so as to seal and receive the ink package 30 inside the ink cartridge 40.

The ink cartridge 40 is slid in the direction of arrow X while the penetrating hole 42 of the ink cartridge 40 faces the ink extracting member 22. Thus, the ink extracting member 22 is stuck into the penetrating hole 42 of the ink cartridge 40. After the ink extracting member 22 is stuck, the ink extracting member 22 is easily stuck into the ink sealing portion 31 from the recess 32 of the ink package 30 received inside the ink cartridge 40. The recess 32 of the ink package 30 is supported by the melt-joined portions 33 and 34 at both of its end portions. Therefore, a change in the shape of the ink sealing portion 31 caused by a load associated with the stick of the ink extracting member 22 can be restrained.

When the ink cartridge 40 continues to be slid in the direction of arrow X, the ink cartridge 40 reaches the left end position of the printer cartridge 3 represented by the alternating long and two short dashed line (the left side in FIG. 1) to finish the fitting of the ink cartridge 40 to the printer cartridge 3. At this time, the laminated structure film material forming the ink package 30 and the ink extracting member 22 intimately contact, thereby preventing leakage of ink from the ink package 30 and invasion of air and the like into the ink package 30.

Ink is extracted into the inside of the ink extracting member 22 stuck into the ink sealing portion 31 of the ink package 30 through the ink extracting opening 22A, and then the ink flows into the ink feeding tube 23 through the joining member 25. The ink fed into the ink feeding tube 23 is supplied into the print head 21 through the joining member 24. By strengthening the toughness of the laminated structure film material forming the ink package 30, a shape restoring ability is provided to such a laminated structure film material and a further change in the shape of the ink sealing portion 31 of the ink package 30 can be restrained. Thus, in the case of using the ink extracting member 22 to extract ink from the ink sealing portion 31, the ink sealing portion 31 is not crushed by atmospheric pressure and the like, and the inner pressure P in the ink sealing portion 31 is kept within a negative pressure. Thus, in the case of supplying the ink extracted with the ink extracting member 22 into the print head 21, ink supplying pressure is kept within a negative pressure. Accordingly, meniscuses M are made inside the respective nozzle openings 21 and consequently an ink jetting ability is kept so that a vivid printed result can be gained.

Subsequently, the printer cartridge 3 is fitted to the printer body 2 under the condition that the print head 21 of the printer cartridge 3 is mounted on the carriage 6 of the printer body 2. When the PC card 15 of the desktop printer 1 is stuck into the PC slot of the personal computer after the printer cartridge 3 is fitted, the desktop printer 1 can transmit/receive printing data and other similar data to/from the personal computer and be operated by receiving electric power from the personal computer.

When the desktop printer 1 receives printing data from the personal computer, printing on the print paper PP is performed. In this case, first the print paper which has not yet been used is inserted into the paper inserting opening (not illustrated) and then the print paper PP is fed on a feeding path below the print head 21 by the platen roller 4. When the fed print paper PP passes through the feeding path below the print head 21, printing is performed with the ink jetted out from the respective nozzle openings 21B of the print head 21. This print paper PP on which printing has been performed is fed out from the sheet feeding-out opening 13.

Figure 9:
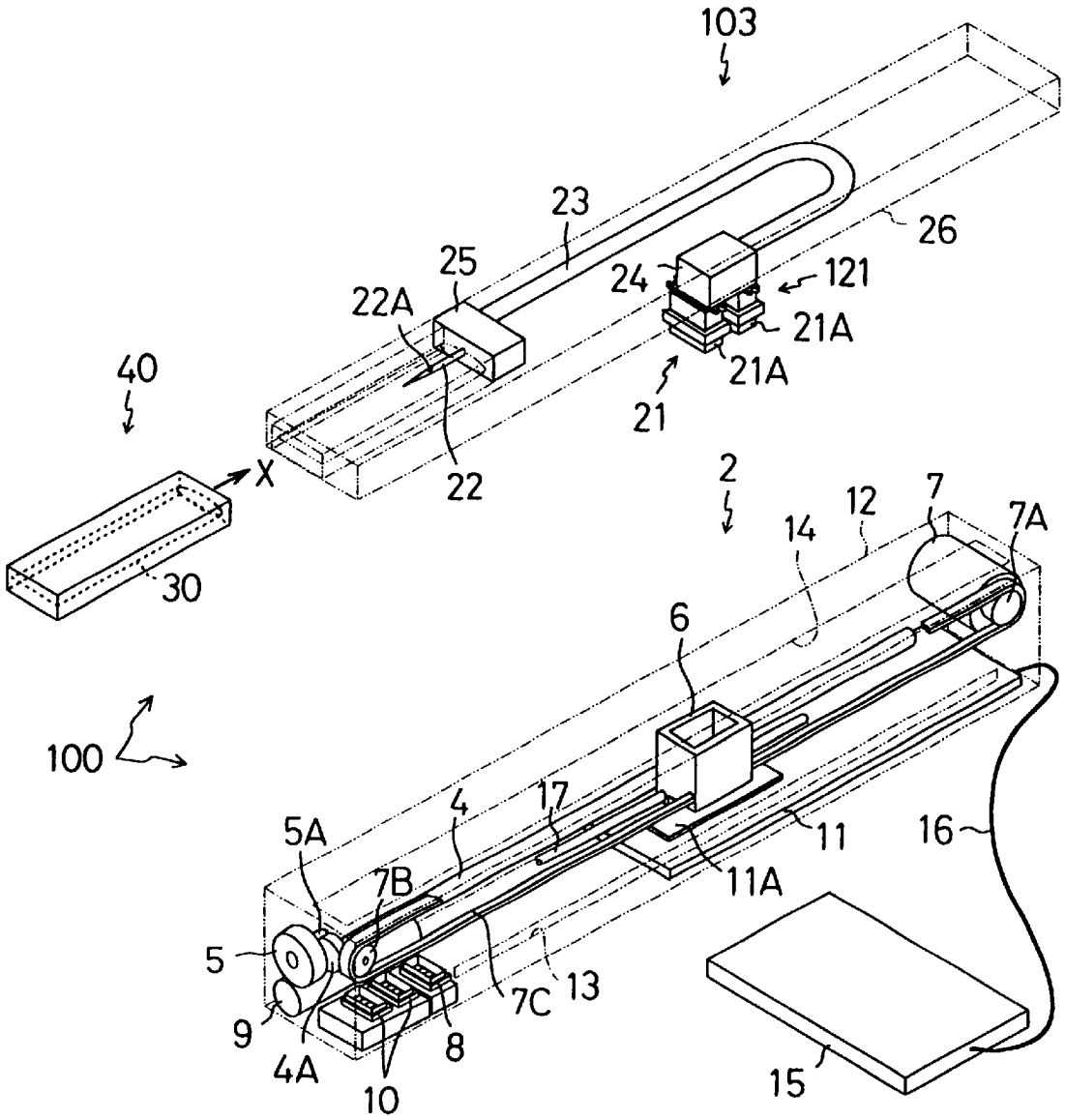
FIG. 9 is a perspective view of a disassembled desktop printer in accordance with a second embodiment of the invention.

The following will describe a desktop printer 100 in accordance with a second embodiment of the invention. In the desktop printer 100 of the second embodiment, the printer cartridge 3 of the desktop printer 1 of the first embodiment described above is altered. The same reference numbers are attached to the same members as in the first embodiment so that explanation thereof is omitted, and only different members are explained. FIG. 9 is a perspective view of the disassembled desktop printer 100 using the ink package 30.

A printer cartridge 103 of the desktop printer 100 has the same type of print head 121 as the print head 21 disposed adjacent to the print head 21. The print head 121 has at its lower portion a nozzle portion 21A and multiple nozzle openings 21B disposed on the lower surface of the nozzle portion 21A, in the same manner as in the print head 21. The respective nozzle openings 21B of the print head 121 are disposed, before and behind the respective nozzle openings 21B of the print head 21 (in the direction perpendicular to the longitudinal direction of the print cartridge 3), to be separated from the openings 21B at a distance of about 360 dpi. Therefore, when printing is performed using both the print heads 21 and 121, printing with a dissolution of 360 dpi can be performed by advancing and returning the carriage 6 on which the print heads 21 and 121 are mounted along the longitudinal direction of the printer body 2. Thus, it is possible to perform printing with a higher dissolution than the desktop printer 1 of the first embodiment for a short time.

The desktop printer 100 and the desktop printer 1 of the first embodiment have common printer bodies 2. Therefore, the printer 100 can be used as the printer 1 by substituting the printer cartridge 103 with the printer cartridge 3 of the first embodiment.

Figure 10:
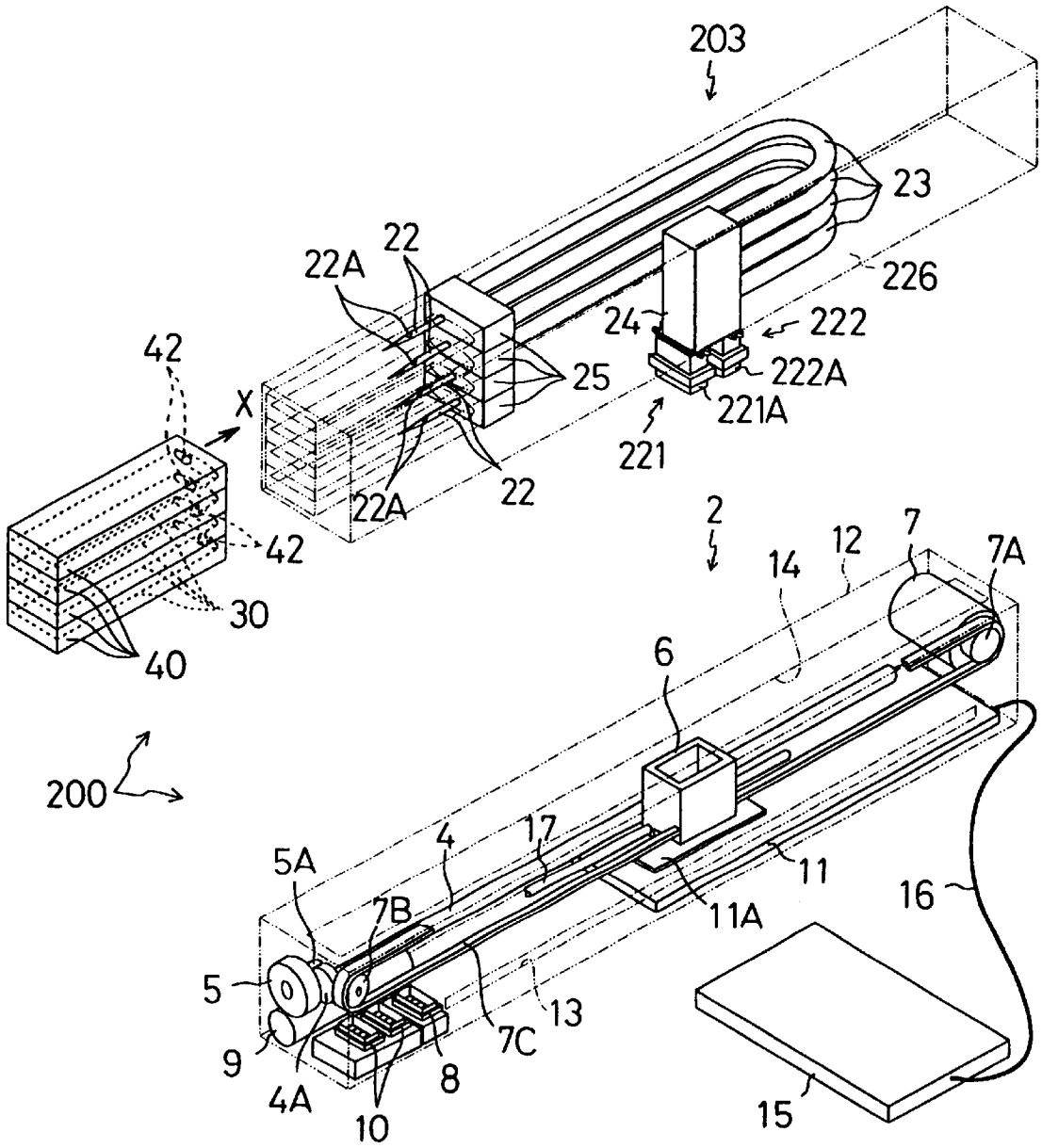
FIG. 10 is a perspective view of a disassembled desktop printer in accordance with a third embodiment of the invention.

The following will describe a desktop printer 200 of the third embodiment, referring to FIG. 10. In the desktop printer 100 of the third embodiment, the printer cartridge 3 of the desktop printer 1 and the ink cartridge 40 of the first embodiment described above are altered. The same reference numbers are attached to the same members as in the first embodiment so that explanation thereof is omitted, and only different members are explained. FIG. 10 is a disassembled, perspective view of the desktop printer 200 using the ink package 30.

To a printer cartridge 203 of the desktop printer 200, four ink cartridges 40 are fitted. The respective ink cartridges 40 receive sealed ink packages 30 in which ink of four colors, that is, black, yellow, cyan and magenta, in this order from the upper in FIG. 10, are disposed. The ink of four colors are jetted from multiple nozzle openings (not illustrated) disposed at respective print heads 221 and 222 and perform full-color printing on the printing paper PP.

Figure 11:
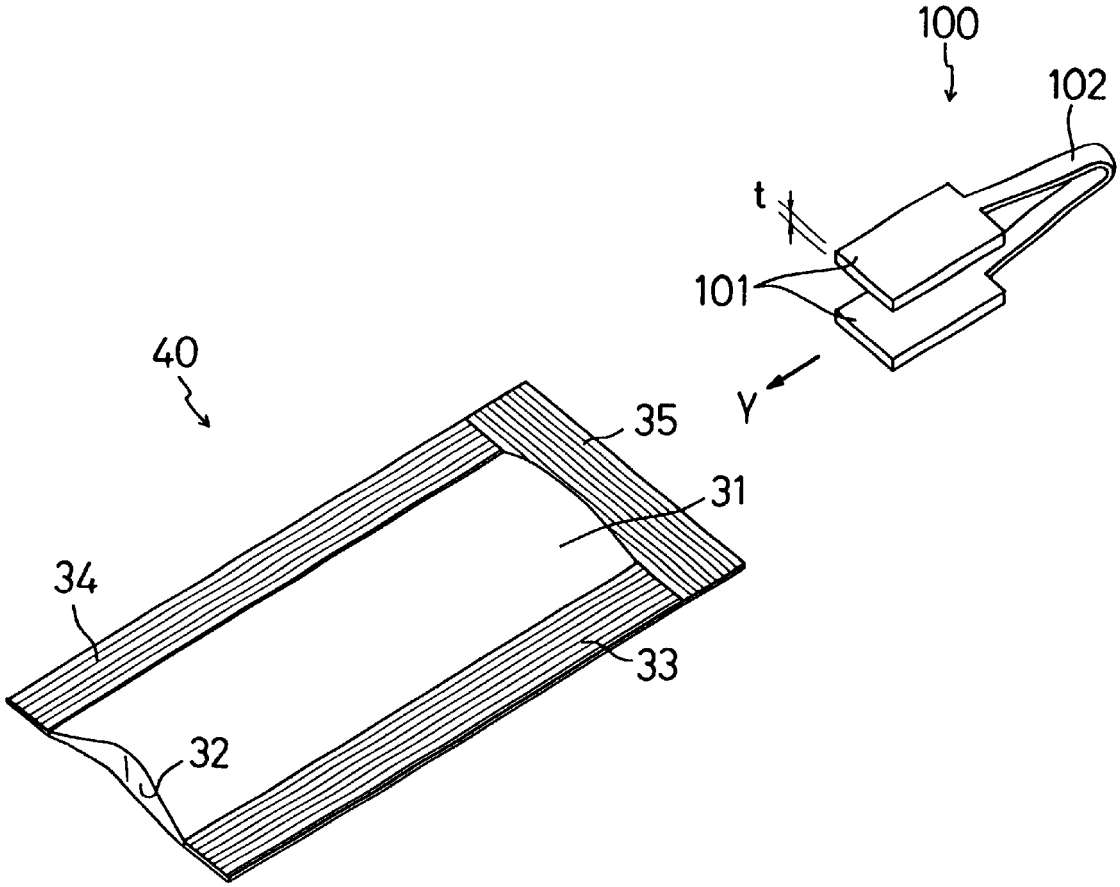
FIG. 11 is a perspective view of a disassembled ink package and plate spring member.
Figure 12:
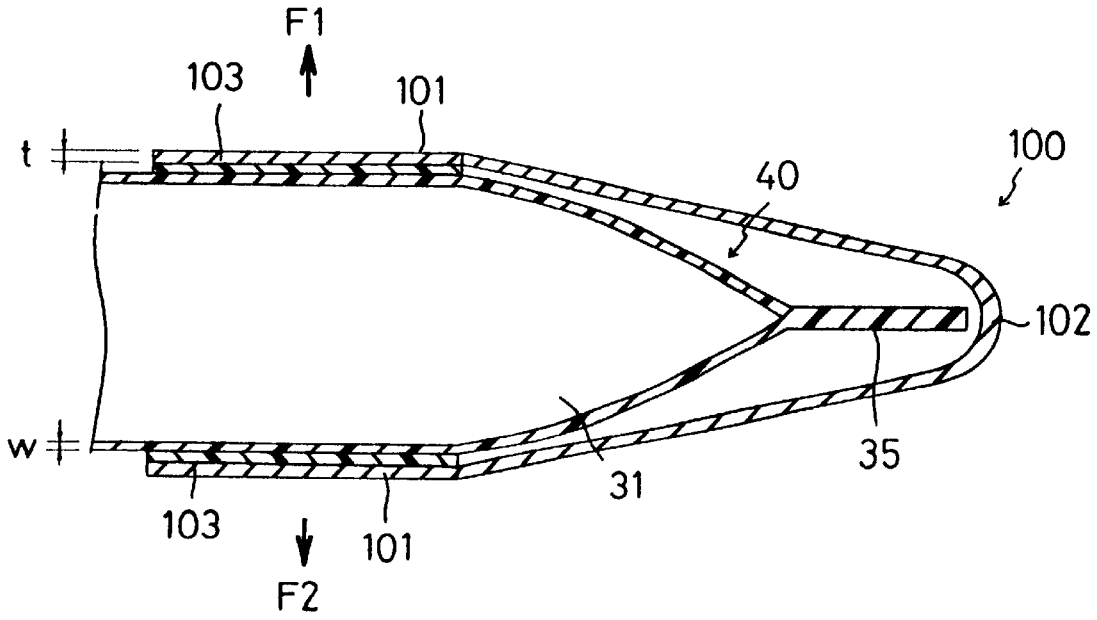
FIG. 12 is a perspective view of an ink package to which the plate spring member is fitted.
Figure 13:
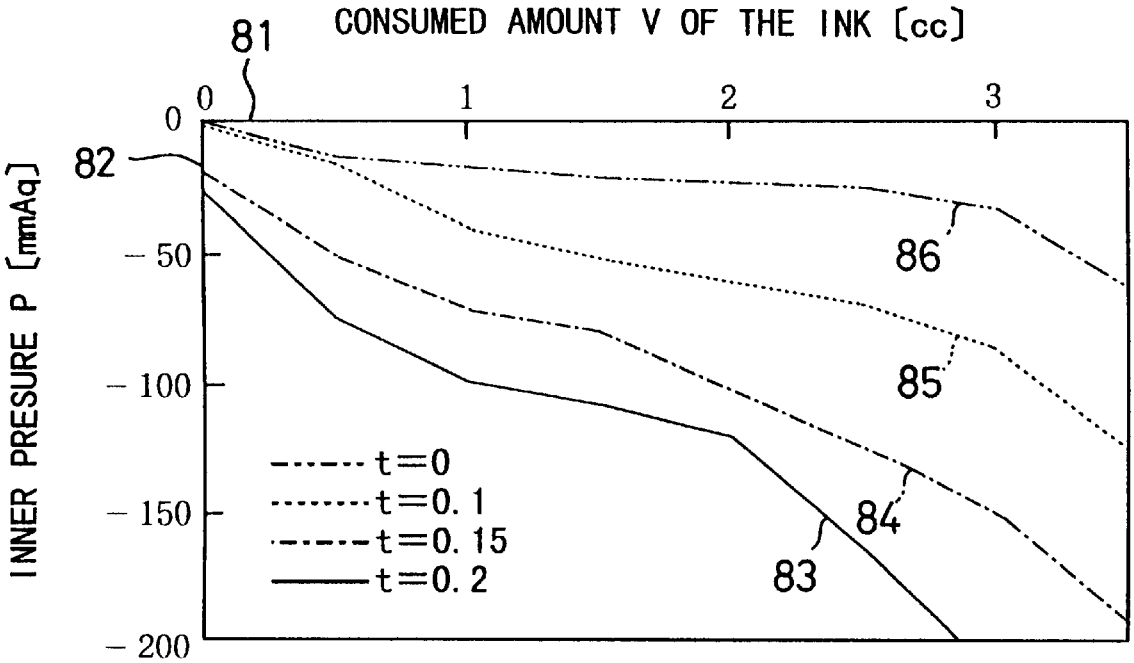
FIG. 13 is a graph comparing ink packages in which the thickness of the plate spring members is different

The following will describe a method for providing a shape-restoring ability to the ink sealing portion 31 of the ink package 40 by using the plate spring member 100. FIG. 11 is a perspective view of the disassembled ink package 40 and plate spring member 100. FIG. 12 is a partial cross section of the ink package 40 to which the plate spring member 100 is fitted. FIG. 13 is a graph showing the relationship between the consumed amount V of ink and the inner pressure P inside the ink sealing portion 31, and comparing ink packages 40 in which the plate spring members 100 have different plate thicknesses t. The arrow Y in FIG. 11 shows the direction along which the plate spring member 100 is fitted to the ink package 40. In FIG. 13, the horizontal axis 81 represents the consumed amount V of the ink sealed inside the ink sealing portion 31, and the vertical axis 82 represents the inner pressure P inside the ink sealing portion 31.

As shown in FIG. 11, a shape-restoring ability can be provided to the ink package 40 by fitting the plate spring member 100 to the ink package 40. The plate spring member 100 is formed into a substantially "<" shape, viewed from the side, and is made of an elastic material such as a spring steel material. The spring plate member 100 has a pair of jointing portions 101 opposite to each other in the vertical direction, and the respective jointing portions 101 are joined to each other through a connector 102. As shown in FIG. 12, in order to fit the plate spring member 100 to the ink package 40, an adhesive agent 103 is applied to the opposite faces of the pair of jointing portions 101 of the plate spring 100, and then the plate spring member 100 is slid in the direction of the arrow Y (see FIG. 11) so that the pair of jointing portions 101 sandwich the ink sealing portion 31 of the ink package 40. Thus, the respective jointing portions 101 of the plate spring member 100 are fitted onto the upper and lower faces of the ink sealing portion 31.

By fitting the plate spring member 100 to the ink sealing portion 31 of the ink package 40 in the aforementioned manner, a change in the shape of the ink sealing portion 31 of the ink package 40 is restrained. Namely, in the case of extracting the ink from the ink sealing portion 31 with the ink extracting member 22, the ink sealing portion 31 is urged toward the F1 and F2 directions as indicated with arrows in FIG. 12, with substantially the same strength, by the plate spring member 100, and consequently the portion 31 is not crushed by atmospheric pressure and the like so that the inner pressure P inside the ink sealing portion 31 can be kept within a negative pressure. As a result, in the case of supplying the ink extracted with the ink extracting member 22 into the printer head, the ink supplying pressure for the ink can be kept within a negative pressure.

Regarding the plate thickness t of the plate members 100 in the ink packages 40 shown in FIG. 13, the curve 83 (solid line), the curve 84 (alternating long and short dashed line) and the curve 85 (alternate long and two short dashed line) represent 0.2 mm, 0.15 mm, and 0.1 mm, respectively. The curve 86 (alternating long and two short dashed line) represents the ink package 40 not using any plate spring member 100.

When the respective curves 83–86 in FIG. 13 are compared, the inner pressure P inside the ink sealing portion 31 drastically decreases in the order of curves 83, 84 and 85, with an increase in the consumed amount V of ink. When curves 83–85 are compared with curve 86, the amount of the inner pressure P, which are each represented by curves 83–85, decreased by an increase in the consumed amount V of ink in the ink packages 40 using the plate spring member 100, are more drastically reduced than the amount of the inner pressure P, which is represented by curve 86, decreased by an increase in the consumed amount V of ink in the ink package not using any plate spring member 100. In short, as the plate thickness t of the plate spring member 100 is larger, the shape-restoring ability of the ink sealing portion 31 is more remarkable and the effect of restraining the change in the shape of the ink sealing portion 31 becomes greater.

The desktop printer 200 and the desktop printers 1 and 100 of the first and second embodiments use common printer bodies 2. Therefore, the printer 200 can be used as the printer 1 or 100 by substituting the printer cartridge 203 with the printer cartridge 3 or 103 of the first or second embodiment.

The respective joining members 25 of the respective extracting members 22 are fitted at different positions along the front and rear direction in FIG. 10. The penetrating holes 42 of the respective ink cartridges 40 are arranged at the positions corresponding to the position of the respective ink extracting members 22. Thus, in the case of fitting the ink cartridges 40 to the printer cartridge 203, the respective ink extracting members 22 cannot be stuck into the respective penetrating holes 42 unless the respective ink cartridges are fitted, in the order of black, yellow, cyan and magenta from the upper position in FIG. 10. Therefore, it is possible to prevent mixing of ink caused by improperly fitting the ink cartridges 40.

The invention has been described on the basis of the embodiments above. However, the invention is not limited to the aforementioned embodiments and may be improved and changed within the scope of the claimed invention, as can be easily presumed.

In the invention, for example, the entire ink package 30 is made of the laminated structure film material, and the ink extracting member 22 is stuck into its recess 32 to extract ink. However, the ink extracting method is not necessarily limited to this. Not using the ink package, ink may be directly sealed into the ink cartridge. In this case, the portion which the ink extracting member is stuck is formed by melt-joining the laminated structure film material to a part of the ink cartridge, and the ink extracting member may be stuck into the laminated structure film material to extract ink inside the ink cartridge. In this case, the ink cartridge may be made of a material compatible with the ink used for printing, for example, polyoxymethylene (POM) type resin.

What is claimed is:

1. An ink supplying device for supplying ink used for printing to a print head, comprising:

an ink package that seals the ink, the ink package being made of a film material that has a shape restoring property that restrains the ink package from changing shape as the ink is withdrawn from the ink package so as to apply a negative pressure to the ink to be supplied to the print head; and an ink extracting member that has a needle-like tip portion that can be stuck into the ink package, the ink extracting member being able to extract the ink from the ink package by sticking the needle-like tip portion into the ink package, and supply the extracted ink into the print head.

2. The ink supplying device according to claim 1, wherein the ink extracting member has an outer diameter that is no larger than approximately 5 mm.

3. The ink supplying device according to claim 1, wherein the ink package has a laminated structure in which a plurality of film sheets that are formed of polyethylene resin are laminated.

4. The ink supplying device according to claim 3, wherein the film material forming the ink package has a thickness from approximately 30 $\mu$m to 300 $\mu$m.

5. The ink supplying device according to claim 3, wherein the ink package has an ink sealing portion that seals the ink, and a longitudinal length of the ink sealing portion is approximately two times or less as long as a lateral length of the ink sealing portion.

6. The ink supplying device according to claim 3, wherein the ink package has an ink sealing portion that seals the ink, and at least one of a longitudinal length and a lateral length of the ink sealing portion is approximately 100 mm or less.

7. The ink supplying device according to claim 3, wherein the ink package has an ink sealing portion that seals the ink, and at least a portion of an exterior surface of the ink sealing portion is formed into at least one of substantially a plane shape and substantially a concave shape.

8. The ink supplying device according to claim 7, wherein both sides of the film material are melt-joined, whereby the portion of the exterior surface of the ink sealing portion that is formed into at least one of substantially the plane shape and substantially a concave shape is made on the face crossing both of the melt-joined sides.

9. The ink supplying device according to claim 3, wherein the ink package includes a deformation restraining member fitted to the ink package to restrain the deformation of the ink package.

10. An ink supplying device for supplying ink used for printing to a print head, comprising:

an ink package that supplies the ink for printing to the print head, the ink package including an upper package and a lower package disposed below the upper package to seal the ink, the upper package having a shape-restoring ability that restrains the ink package from changing shape as the ink is withdrawn from the ink package so as to apply a negative pressure to the ink to be supplied to the print head; and an ink extracting member that includes a needle-like tip portion that can be stuck into the ink package, the ink extracting member being able to extract the ink from the ink package by sticking the needle-like tip portion into the ink package, and supply the extracted ink into the print head.

11. The ink supplying device according to claim 10, further including an ink cartridge that defines a penetrating hole, the penetrating hole being defined at a position corresponding to the ink extracting member.

12. The ink supplying device according to claim 10, wherein the upper package and the lower package are made of a film material having the shape restoring ability, and the shape-restoring ability of the film material that forms the upper package is larger than the shape-restoring ability of the film material that forms the lower package.

13. The ink supplying device according to claim 10, wherein the ink package includes a deformation restraining member that is fitted to at least one of the upper package and the lower package to restrain the deformation of the ink package, the other of the upper package and the lower package being made of a film material having the shape-restoring ability, and the film material that forms at least one of the upper package and the deformation restraining member fitted to the upper package is more rigid than the deformation restraining member fitted to at least one of the lower package and the film material that forms the lower package.

14. An ink package for supplying ink for printing to a printer head, comprising:

an ink package that is made of a film material that has a shape restoring property that restrains the ink package from changing shape as the ink is withdrawn from the ink package so as to apply a negative pressure to the ink to be supplied to the printer head.

15. The ink package according to claim 14, wherein the ink package has a laminated structure in which a plurality of film sheets that are formed of polyethylene resin are laminated.

16. The ink package according to claim 15, wherein the film material forming the ink package has a thickness of approximately 30 $\mu$m to 300 $\mu$m.

17. The ink package according to claim 15, wherein the ink package has an ink sealing portion that seals the ink, and a longitudinal length of the ink sealing portion is approximately two times or less as long as a lateral length of the ink sealing portion.

18. The ink package according to claim 15, wherein the ink package has an ink sealing portion that seals the ink, and at least one of a longitudinal length and a lateral length of the ink sealing portion is approximately 100 mm or less.

19. The ink package according to claim 15, wherein the ink package has an ink sealing portion that seals the ink, and at least a portion of an exterior surface of the ink sealing portion is formed into at least one of a substantially plane shape and a substantially concave shape.

20. The ink package according to claim 19, wherein both sides of the film material are melt-joined, whereby the portion of the exterior surface of the ink sealing portion that is formed into at least one of a substantially plane shape and a substantially concave shape is made on a face crossing both of the melt-joined sides.

21. The ink package according to claim 15, wherein the ink package includes a deformation restraining member fitted to the ink package to restrain the deformation of the ink package.

22. An ink package system for supplying ink for printing to a printer head, comprising:

an upper package made of a film material having a shape restoring ability that restrains the upper package from changing shape as the ink is withdrawn from the upper package so as to apply a negative pressure to the ink to be supplied to the printer head; and the film material a lower package which is disposed below the upper package so as to seal the ink.

23. The ink package system according to claim 22, wherein the upper package and the lower package are made of a film material having the shape restoring ability, and the shape-restoring ability of the film material that forms the upper package is larger than the shape-restoring ability of the film material that forms the lower package.

24. The ink package system according to claim 22, wherein the ink package includes a deformation restraining member that is fitted to at least one of the upper package and the lower package to restrain the deformation of the at least one of the upper package and the lower package, the other of the at least one of the upper package and the lower package being made of the film material having the shape-restoring ability; and the film material for forming at least one of the upper package and the deformation restraining member fitted to the upper package being more rigid than the deformation restraining member fitted to at least one of the lower package and the film material that form the lower package.

25. An ink cartridge for use with ink to be supplied to a print head, comprising:

an ink package made of a film material that has a shape restoring property that restrains the ink package from changing shape as the ink is withdrawn from the ink package so as to apply a negative pressure to the ink to be supplied to the print head;

a cartridge case housing the ink package, the cartridge case being made of a rigid material, and defining a penetrating hole; and a sealing member that covers the penetrating hole and maintains the cartridge case as airtight.

26. The ink cartridge according to claim 25, wherein the ink package has a laminated structure in which a plurality of film sheets that are formed of polyethylene resin are laminated.

27. The ink cartridge according to claim 26, wherein the film material that forms the ink cartridge has a thickness of approximately 30 $\mu$m to 300 $\mu$m.

28. The ink cartridge according to claim 26, wherein the ink package has an ink sealing portion for sealing up the ink, and a longitudinal length of the ink sealing portion is about two or less times as long as a lateral length thereof.

29. The ink cartridge according to claim 26, wherein the ink package has an ink sealing portion that seals the ink, and at least one of a longitudinal length and a lateral length of the ink sealing portion is approximately 100 mm or less.

30. The ink cartridge according to claim 26, wherein the ink package has an ink sealing portion that seals the ink, and at least a portion of an exterior surface of the ink sealing portion is formed into at least one of a substantially plane shape and a substantially concave shape.

31. The ink cartridge according to claim 30, wherein both sides of the film material are melt-joined, whereby the portion of the exterior surface of the ink sealing portion formed into at least one of substantially a plane shape and substantially a concave shape is made on a face crossing both of the melt-joined sides.

32. The ink cartridge according to claim 26, wherein the ink package includes a deformation restraining member fitted to the ink package to restrain the deformation of the ink package.

* * * * *